US010221864B2

(12) United States Patent
Hölzer

(10) Patent No.: US 10,221,864 B2
(45) Date of Patent: Mar. 5, 2019

(54) VACUUM PUMP

(71) Applicant: Oerlikon Leybold Vacuum GmbH, Köln (DE)

(72) Inventor: Rainer Hölzer, Hürth (DE)

(73) Assignee: LEYBOLD GMBH, Köln (DE)

( * ) Notice: Subject to any disclaimer, the term of this patent is extended or adjusted under 35 U.S.C. 154(b) by 427 days.

(21) Appl. No.: 15/022,448

(22) PCT Filed: Sep. 11, 2014

(86) PCT No.: PCT/EP2014/069344
§ 371 (c)(1),
(2) Date: Mar. 16, 2016

(87) PCT Pub. No.: WO2015/043962
PCT Pub. Date: Apr. 2, 2015

(65) Prior Publication Data

US 2016/0298649 A1 Oct. 13, 2016

(30) Foreign Application Priority Data

Sep. 24, 2013 (DE) ..... 20 2013 088 470 U

(51) Int. Cl.
*F04D 29/58* (2006.01)
*F04D 19/04* (2006.01)
(Continued)

(52) U.S. Cl.
CPC ..... *F04D 29/5853* (2013.01); *F04D 19/04* (2013.01); *F04D 19/042* (2013.01);
(Continued)

(58) Field of Classification Search
CPC .. F04D 29/5853; F04D 29/522; F04D 29/056; F04D 19/042; F04D 25/06; F04D 29/584; F04D 29/5806; F04D 19/04
See application file for complete search history.

(56) References Cited

U.S. PATENT DOCUMENTS 5,020,969 A 6/1991 Mase et al.
5,577,883 A * 11/1996 Schutz ..... F04D 19/04 415/177
(Continued)

FOREIGN PATENT DOCUMENTS

DE 3508483 A1 10/1986
DE 3932228 A1 4/1990
(Continued)

OTHER PUBLICATIONS

International Search Report and English translation dated Nov. 27, 2014 from corresponding International Application No. PCT/EP2014/069344, 7 pages.
(Continued)

*Primary Examiner* — Eldon T Brockman
(74) *Attorney, Agent, or Firm* — Ohlandt, Greeley, Ruggiero & Perle, LLP

(57) ABSTRACT

A vacuum pump comprises a rotor shaft, which bears one or more rotor elements. The rotor shaft is driven by an electrical driver. A stator is arranged between the rotor elements. The rotor shaft is supported by bearings. The highly heat-generating components such as the driver and the stator are connected to a second housing part in particular by means of a support member. Heat-sensitive components such as the bearing are supported by means of a separate first housing part. The two housing parts can be kept at different temperatures, for example by means of separate cooling devices. Thus, the operating temperature of the in particular pressure-side bearing can be reduced, and therefore the service life can be extended.

9 Claims, 1 Drawing Sheet

(51) Int. Cl.
*F04D 25/06* (2006.01)
*F04D 29/056* (2006.01)
*F04D 29/52* (2006.01)

(52) U.S. Cl.
CPC ..... *F04D 25/06* (2013.01); *F04D 29/056* (2013.01); *F04D 29/522* (2013.01); *F04D 29/584* (2013.01); *F04D 29/5806* (2013.01)

(56) References Cited

U.S. PATENT DOCUMENTS

| | | | | |
|---|---|---|---|---|
| 6,926,493 | B1 * | 8/2005 | Miyamoto ..... | F04D 19/042 415/143 |
| 2002/0114695 | A1 | 8/2002 | Fahrenbach | |
| 2006/0245960 | A1 | 11/2006 | Schooling et al. | |

FOREIGN PATENT DOCUMENTS

| | | | |
|---|---|---|---|
| DE | 602004012546 | T2 | 4/2009 |
| DE | 202013008470 | U1 | 1/2015 |
| EP | 0855517 | A2 | 7/1998 |
| EP | 1236906 | A1 | 9/2002 |
| EP | 1344940 | A1 | 9/2003 |
| WO | 94/00694 | | 1/1994 |

OTHER PUBLICATIONS

Written Opinion dated Nov. 27, 2014 from corresponding International Application No. PCT/EP2014/069344, 6 pages.

* cited by examiner

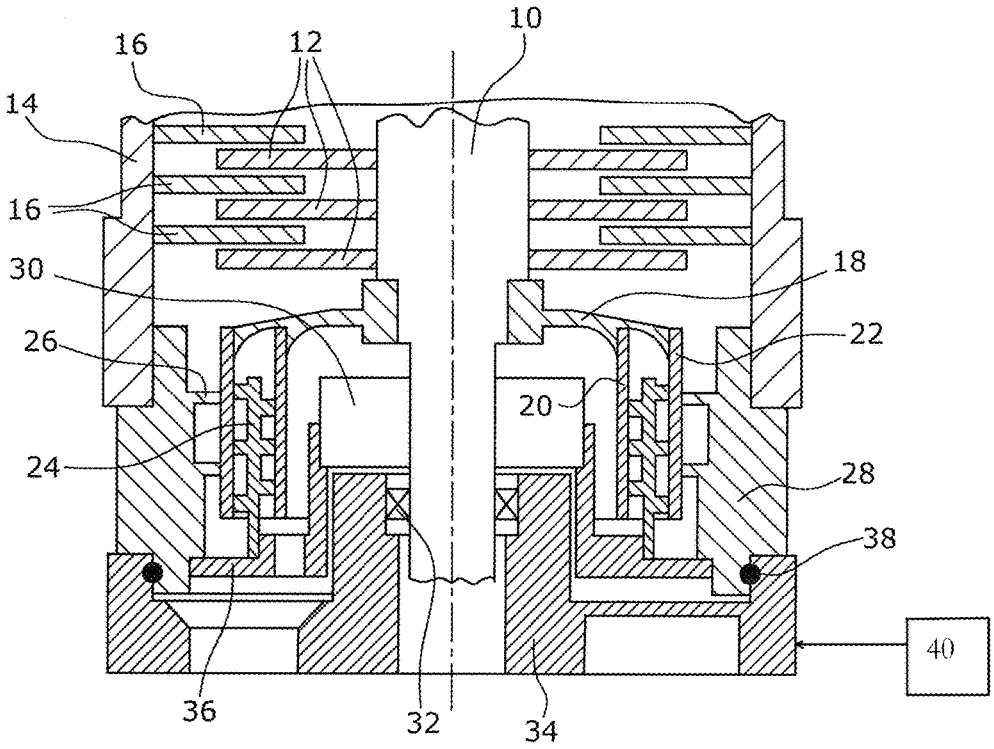
10
16
12
14
16
30
18
26
22
20
24
28
38
40
36
32
34

VACUUM PUMP

BACKGROUND

1. Field of the Disclosure

The disclosure relates to a vacuum pump, in particular a turbomolecular pump.

2. Discussion of the Background Art

Vacuum pumps have a rotor shaft that typically is connected with a plurality of rotor elements. With a turbomolecular pimp, for example, the rotor elements are a plurality of rotor discs extending substantially radially with respect to the rotor shaft. Stator discs usually connected with a housing or arranged in the housing are provided between the rotor discs, so that the stator discs are a plurality of individual stator means. The individual stator discs are thus arranged between adjacent rotor discs. Similarly, a rotor element may be, for example, formed by rotating elements of a Holweck stage, a Siegbahn stage or a Gaede stage, as well as a rotor of a side-channel compressor. Due to compression, high temperatures occur in particular in such types of pumps. The rotor shaft of the vacuum pump is further connected with a drive means, such as a, electric motor. Such components also often generate high temperatures. It is thus required to cool such components that generate large amounts of heat.

The rotor shaft is supported by bearings. Rolling bearings in particular are temperature-sensitive, however. At high operating temperatures the service life of the rolling bearings is shortened. Often, the bearings, in particular the bearing on the pressure side, are arranged in a confined installation space and thus close to the electric drive unit, as well as to the region where a high compression of gas occurs and thus a large quantity of dissipated heat is generated. As a consequence, the bearings are operated at a high operating temperature.

It is an object of the disclosure to reduce the operating temperature of bearings, in particular rolling bearings, in vacuum pumps using constructionally simple means.

SUMMARY

A vacuum pump comprises a rotor shaft and at least one rotor element. Further, at least one stator element is provided that cooperates with the at least one rotor element. Further, the rotor shaft is connected with a drive means, as well as with bearings supporting the rotor shaft. Moreover, the vacuum pump has a housing in which the components of the pump are arranged. In particular, the housing supports the rotor shaft via the bearings. Further, the at least one stator means is connected wither directly or indirectly with the housing. According to the disclosure the housing has a plurality of housing parts, with heat-sensitive components being connected with a first housing part and highly heat-generating components are connected with a second housing part. Due to this arrangement it is possible that the strong heat generated for example in the compressor part and/or by the drive means is dissipated so that the operating temperature of heat-sensitive components, in particular a bearing, can be reduced. Thus, according to the disclosure, the strong heat generated in the pump is introduced as little as possible into the bearing. According to the disclosure, this is achieved with a simple constructional measure, since the housing has at least two housing parts and these support either the heat-sensitive components or the highly heat-generating components.

Preferably, the second housing part is connected with the drive means in a thermally conductive manner. Thus, the heat generated by the drive means can be dissipated in a simple manner. In the preferred embodiment, the second housing part is connected with the drive means via a support member. This facilitates the assembly in particular. It is further preferred that the support member caries further components via which the heat can be dissipated to the second housing part. Specifically, these are components connected with the compression portion, so that the heat is dissipated from there to the second housing part. It is thus preferred that at least one stator means is connected with the support means. Specifically, these may be stator means of the Holweck stage, the Siegbahn stage, the Gaede stage or a side-channel compressor. A connection with such stator means is particularly advantageous, since, in such stages, high compression is performed and therefore large quantities of heat are generated.

In a particularly preferred embodiment the second housing part is thus connected with the support member and/or the drive means and/or at least one stator means in a thermally well conductive manner. The connection is made in particular by pressing the components with an interference fit. Thereby, good thermal conductivity can be achieved.

In a preferred embodiment of the disclosure the first housing part is connected with a bearing, in particular the pressure-side bearing. In particular in case of compact structure vacuum pump the pressure-side bearing is greatly affected by the heat development of the drive means and/or the compression portion of the pump. This is particularly true, if this bearing is surrounded by a Holweck stage or the like.

In another preferred development the first housing part is connected, in addition to or instead of the connection with the bearing, with a control means that in particular generates only little heat.

It is further preferred that the first housing part and the second housing part are connected with each other by a connection having a low thermal conductivity. For example, this may be a screw connection, possibly with a sealing element such as an air gap or the like being provided. In particular it is also possible that the chambers of the two housing parts are thermally decoupled from each other.

By providing two separate housing parts it is possible to keep them on different temperature levels by means of a separate cooling device. In particular it is possible to cool the first housing part more intensely, so that the operating temperature of the bearing and/or a control means is low. Thereby, it is possible for example to drastically extend the service life of a bearing. With housing parts not separated, this would only be possible by strongly cooling also the highly heat-generating components. This would entail a significantly higher energy input.

Connecting the highly heat-generating components by means of a support member, in particular by pressing, has the further advantage that besides a good thermal conductivity, also the positioning of these components is defined in a very precise manner. This is suitably in particular in case of a stator of a Holweck stage or the like, which is carried by the support member. It is further preferred that the stator of the motor is connected with the support member by pressing. Thus, also the position of the motor stator is clearly defined.

The disclosure will be described hereunder in more detail with reference to a preferred embodiment and to the accompanying drawing.

BRIEF DESCRIPTION OF THE DRAWINGS

The FIGURE shows a much simplified schematic sectional view of a part of a vacuum pump.

DETAILED DESCRIPTION OF THE PREFERRED EMBODIMENT

In the vacuum pump schematically illustrated in the FIGURE, a rotor shaft 10 carries a plurality of rotor elements designed as rotor discs 12. In the region of turbomolecular stage stator discs 16 are connected with an upper housing part 14 or are supported by the upper housing part.

Further, a disc-shaped support 18 is rigidly connected with the rotor shaft 10. In the embodiment illustrated, the support 18 supports two rotor elements 20, 22 of a Holweck stage, the elements being designed as tubular cylinders. An inner stator means 24 of the Holweck stage is arranged between the rotor elements 20, 22 of the Holweck stage. The outer rotor element 22 is surrounded by another stator means 26 of the Holweck stage, wherein, in the embodiment illustrated, this outer stator means 26 is connected integrally with a second housing part 28 or formed on the inner side of the second housing part 28.

The rotor shaft 10 further carries a drive means 30. The pressure-side end of the rotor shaft 10, i.e. the lower end in the FIGURE, is supported by a rolling bearing 32. The rolling bearing 32 is arranged in a first housing part 34.

In the embodiment illustrated the motor stator is rigidly connected with a support member 36 for dissipating heat from the drive means 30 or the motor stator of the drive means 30. The connection is made in particular by pressing. The support member 36 further carries the stator means 24 that is also connected with the support member 36 by pressing. The support member 36 is thus connected with the second housing part 28 in a rigid and thermally well conductive manner. The strong heat generated in the region of the Holweck stage, as well as the strong heat generated by the drive means 30 are thus induced outwards into the second housing part 28 via the thermally well conductive press-fit connections.

Separated from the above, the bearing 32 is connected with the first housing part 34. The first housing part 34 is connected with the second housing part 28 by means of screws or the like, for example. Possibly, a seal 38 is additionally provided in this region. In particular, the thermal conductivity between the first housing part 34 and the second housing part 28 is as low as possible. Thereby, it is possible to cool the first housing part 34 separately from the second housing part 28 via a separate cooling device 40 so that the operating temperature of the bearing 32 can be reduced. This results in an extension of service life.

What is claimed is:

1. A vacuum pump, comprising:

rotor elements connected with a rotor shaft, at least one stator cooperating with the rotor elements, an electric driver that drives the rotor shaft, bearings supporting the rotor shaft, and a housing having a first housing part and a second housing part, wherein heat-sensitive components are connected with the first housing part and heat-generating components are connected to the second housing part, wherein the second housing part is connected with the electric driver in a thermally conductive manner via a support member.

2. The vacuum pump of claim 1, wherein the support member is connected at least with a portion of the at least one stator, the portion being selected from the group consisting of a Holweck stage, a Siegbahn stage, a Gaede stage, and a side-channel compressor.

3. The vacuum pump of claim 1, wherein the second housing part is connected with the support member and/or the electric driver and/or the at least one stator in a thermally conductive manner.

4. The vacuum pump of claim 1, wherein the first housing part is connected with one of the bearings.

5. The vacuum pump of claim 4, wherein the one of the bearings is a pressure-side bearing.

6. The vacuum pump of claim 1, wherein the first housing part is connected with a controller.

7. The vacuum pump of claim 1, wherein the first housing part and the second housing part are connected via a connection of low thermal conductivity.

8. The vacuum pump of claim 1, wherein the first housing part and the second housing part are thermally decoupled from each other.

9. The vacuum pump of claim 1, wherein the first housing part is connected with a separate cooler device.

* * * * *